US006733341B1

(12) United States Patent
Bugg

(10) Patent No.: US 6,733,341 B1
(45) Date of Patent: May 11, 2004

(54) NETWORK INTERFACE ADAPTER

(75) Inventor: Kenneth F. Bugg, Decatur, GA (US)

(73) Assignee: Bellsouth Intellectual Property Corporation, Wilmington, DE (US)

( * ) Notice: Subject to any disclaimer, the term of this patent is extended or adjusted under 35 U.S.C. 154(b) by 8 days.

(21) Appl. No.: 09/740,233

(22) Filed: Dec. 19, 2000

(51) Int. Cl.[7] ..... H01R 25/00
(52) U.S. Cl. ..... 439/638
(58) Field of Search ..... 439/652, 535, 439/131, 638, 639, 676, 620

(56) References Cited

U.S. PATENT DOCUMENTS 4,290,664 A * 9/1981 Davis et al. ..... 439/638
4,362,905 A * 12/1982 Ismail ..... 439/676
4,611,875 A * 9/1986 Clarke et al. ..... 439/638
4,738,635 A * 4/1988 Harrington et al. ..... 439/676
5,687,213 A * 11/1997 Larkin ..... 439/676
5,930,340 A * 7/1999 Bell ..... 379/93.08
6,135,811 A * 10/2000 Daoud ..... 439/676
6,290,543 B1 * 9/2001 Plummer, Jr. et al. ..... 439/639

* cited by examiner

*Primary Examiner*—Renee Luebke
*Assistant Examiner*—Felix O. Figueroa
(74) *Attorney, Agent, or Firm*—Woodcock Washburn LLP

(57) ABSTRACT

An interface adapter for installing an asymmetrical digital subscriber line (ADSL) at a subscriber location is disclosed. The adapter includes a housing, a plurality of electrical conductors, a plug connector, and a receptacle connector. The electrical conductors extend into an interior region of the adapter through an entrance face of the housing. A first subset of the electrical conductors extends through a plug face of the housing and connect to a plug connector that is located in a region exterior to the housing. A second subset of the electrical conductors extends through the interior region and connect to a receptacle connector that is disposed on a receptacle face of the housing and accessible from the exterior region to receive a compatible plug connector. The adapter can also include one or more data terminals connected to a third subset of the electrical conductors. The conductors can be electrically coupled to an ADSL filter.

8 Claims, 3 Drawing Sheets

NETWORK INTERFACE ADAPTER

FIELD OF THE INVENTION

This invention relates generally to telephone installations, and in particular to an adapter for installation of an asymmetrical digital subscriber line (ADSL) interface.

BACKGROUND OF THE INVENTION

A standard telephone installation in the United States includes at least a pair of copper wires contained in a cable that the telephone company installs in a home or business. Each copper wire is capable of carrying a much greater bandwidth than is required to carry voice conversations. For example, human voices, speaking in normal conversational tones, can be carried in a frequency range of 0 to 3400 Hz. As telephone wires typically have the potential to carry frequencies of up to several million Hertz, the unused portion of the bandwidth can be exploited to carry data (e.g., for Internet access). An asymmetrical digital subscriber line (ADSL) is a telephone line that can be used for simultaneous transmissions of both voice and data.

To install a standard telephone line in a home or business, a telephone cable is usually laid from the street to the house. A typical telephone cable contains at least four separate metal wires, each wire encased in a insulating material. The house or business telephone system is connected to the public switching telephone network (PSTN) through a network interface device (NID). The FCC currently mandates that the NID terminate with a modular receptacle jack, also known as an RJ connector, so that before making a service call, the home or business owner can determine where a telephone line problem originates by plugging a telephone directly into the NID. If the telephone works, the problem is located on the customer's side of the NID; otherwise, the problem is located on the telephone company's side of the NID.

Typically inside but sometimes outside the house the cable enters a junction box which typically is contained within or located adjacent to the housing containing the NID. Inside the junction box the cable is opened, the wires are separated from each other, and at least one pair of wires are connected to screws called lugs. Frequently home or business owners or vendors such as burglar alarm companies and satellite and cable TV companies will tap into a customer's telephone lines by attaching their own wires to the lugs in the junction box, or if there are already too many wires attached to the lugs, the third-party systems may be spliced into wires attached to the lugs.

If an ADSL is in use in the household or business, a low bandpass filter must be installed because transmission on the data portion of the bandwidth will interfere with the voice signals of the lines used for regular (voice) telephone calls. The low bandpass filter blocks all signals above a certain frequency on those lines that will be used for only telephone calls to prevent data signals from interfering with voice signals, causing static on the telephone line. Installation of this filter typically takes approximately 20 minutes because splicing is necessary and tends to be rather difficult because space in the junction box is limited and the junction box typically already contains a number of wires and lugs. Splicing is undesirable and is a potential source of static problems because during splicing, wires may be stripped of their insulating covering and twisted together. Sometimes the fragile wires are damaged, creating a "high open" which may cause static on the line. Also, because the wires are now exposed, corrosion of the wires is likely to occur over time.

Burglar alarm systems and cable television systems are typically wired to the lugs in the junction box. If these systems are wired to the lugs at a point before the filter, signals from the CATV or burglar alarm can interfere with the ADSL signals. Frequently, installers of burglar alarm systems and television systems arc unaware of the presence of an ADSL. Wiring a CATV or burglar alarm system to a point before the filter can result in static on the ADSL, which can lead to interference with data transmission or to interruption of the connection. Such problems are difficult to find and correct because repair persons may be unaware of the installation of the burglar alarm or television system.

It would be advantageous to installers of such interfaces, and cost effective for subscribers of such services, if apparatus and methods existed whereby the installer could easily, quickly, and accurately install an ADSL filter at the subscriber's location. It would be desirable that such systems eliminate the need, for splicing, and reduce the likelihood of erroneous installation of third-party systems. Thus there is a need in the art for an ADSL interface adapter according to the present invention.

SUMMARY OF THE INVENTION

The present invention meets the aforementioned needs by providing an ADSL interface adapter that facilitates connection of the ADSL interface into the telephone network at a subscriber location. An interface adapter according to the present invention includes a housing, a plurality of electrical conductors, a plug connector, and a receptacle connector.

The housing defines an interior region of the adapter and an exterior region. The plurality of electrical conductors extend into the interior region of the adapter through an entrance face of the housing. The plug connector is located in the exterior region and is coupled to a subset of the electrical conductors that extends through a plug face of the housing between the interior region of the adapter and the plug connector.

The receptacle connector is disposed on a receptacle face of the housing and is accessible from the exterior region to receive a compatible plug connector. The receptacle connector is coupled to a subset of the electrical conductors that extends through the interior region of the adapter.

The adapter can also include one or more data terminals connected to a third subset of the electrical conductors. The data terminals are disposed on a terminal face of the housing such that they are accessible from the exterior region.

According to one aspect of the present invention, the housing is constructed such that the entrance face is opposite the terminal face, the plug face is opposite the receptacle face, and the entrance face extends between the plug face and the receptacle face.

According to another aspect of the invention, an interface adapter includes an asymmetrical digital subscriber line (ADSL) filter, a plug connector coupled to the ADSL filter by a first set of electrical conductors, and a receptacle connector coupled to the ADSL filter by a second set of electrical conductors. The adapter can also include a data terminal coupled to the ADSL filter by a third set of electrical conductors.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings an embodiment that is presently preferred, it being understood, however, that the invention is not limited to the specific apparatus and methods disclosed.

DETAILED DESCRIPTION OF PREFERRED EMBODIMENTS

Figure 1:
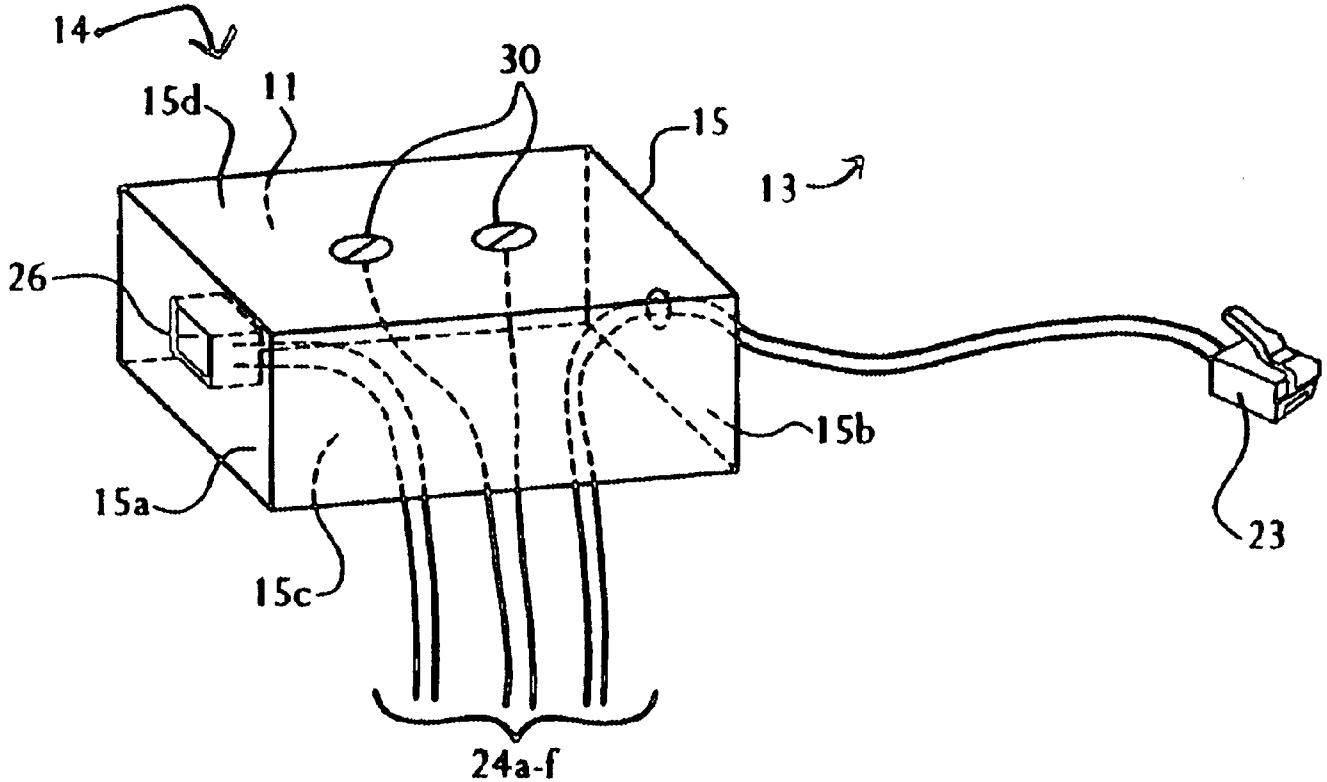
FIG. 1 depicts an interface adapter according to the present invention.
Figure 2:
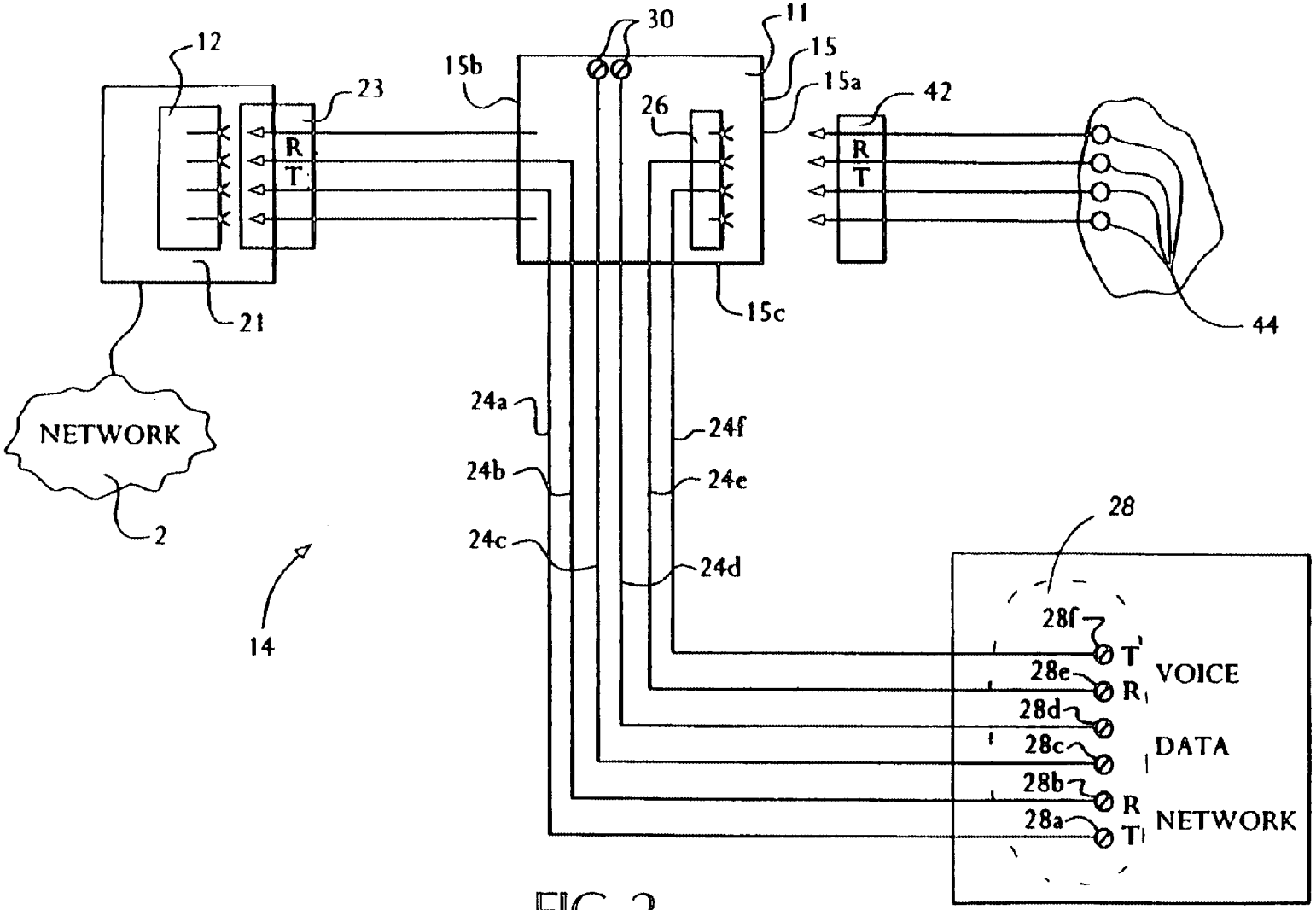
FIG. 2 is a schematic diagram of an interface adapter according to the present invention.

As shown in FIGS. 1 and 2, an interface adapter 14 according to the present invention includes a housing 15 that defines an interior region 11 of adapter 14 and an exterior region 13 exterior to housing 15. Preferably, housing 15 includes a receptacle face 15*a*, a plug face 15*b* opposite receptacle face 15*a*, an entrance face 15*c* extending between receptacle face 15*a* and plug face 15*b*, and a terminal face 15*d* opposite entrance face 15*c*. Housing 15 can be constructed from any suitable insulating material, such as a plastic, for example, and can be transparent, translucent, or opaque.

A plurality of electrical conductors 24*a–f*, such as copper wires, for example, extend through entrance face 15*c* into interior region 11. The portions of conductors 24*a–f* that extend exterior to housing 15 can be of any length that is suitable for the application in which the invention is practiced. Preferably, conductors 24*a–f* are coated with an insulating sheathing material such as polyvinyl chloride, for example.

Conductors 24*a* and 24*b* extend through plug face 15*b*, and terminate at a plug connector 23, which is adapted to be inserted into a compatible receptacle connector 12. Receptacle connector 12 can be in a network interface device (NID), for example. Preferably, plug connector 23 is a male, RJ 11-type plug connector. Conductors 24*c* and 24*d* terminate in interior region 11 at data terminals 30. Preferably, data terminals 30 are metal screws or lugs. Conductors 24*e* and 24*f* also terminate in interior region 11 at a receptacle connector 26. Receptacle connector 26 is disposed on a receptacle face 15*a* of housing 15, and is accessible from exterior region 13. Receptacle connector 26 is adapted to receive a compatible plug connector 42. Preferably, receptacle connector 26 is a female, RJ 11-type jack.

Each of conductors 24*a–f* is electrically connected, e.g., by splicing, twisting, or any similar technique, to a corresponding lug 28*a–f* in ADSL filter (or "splitter") 28. As shown, conductors 24*a* and 24*b* electrically couple network terminals 28*a*, 28*b* in filter 28 to a telephone network 2 when plug connector 23 is received into receptacle connector 12. Typically, network 2 is a public switching telephone network (PSTN), and receptacle connector 12 is part of a network interface device (NID) 21 installed at the subscriber location. Conductors 24*c* and 24*d* electrically connect data terminals 28*c*, 28*d* in filter 28 to data terminals 30 in interface adapter 14. Conductors 24*e* and 24*f* electrically couple voice terminals 28*e*, 28*f* in splitter 28 with lugs 44 (which can be located in a junction box at the subscriber location) when plug connector 42 is received into receptacle connector 26.

Preferably, to expedite installation in the field, conductors 24*a–f* are connected to lugs 28*a–f* at a factory or other service provider location, thereby coupling conductors 24*a–f* with filter 28. Once filter 28 is installed at the subscriber location, introduction of filter 28 into the circuit is a simple matter. First, the installer removes plug connector 42 from receptacle connector 12. Then, all that the installer needs to do is to insert plug connector 42 into receptacle connector 26, and plug connector 23 into receptacle connector 12.

In use, after filter 28 and interface adapter 14 have been installed at the subscriber location, conductor 24*b* carries combined signals that include information at both high frequency (e.g., data) and low frequency (e.g., voice) from network 2 to filter 28. Filter 28 separates the low frequency signal from the combined signal (or, more precisely, filters out the high frequency signal from the combined signal), and conveys the low frequency signal along conductor 24*e* to the subscriber's internal phone lines. When the customer uses his or her telephone, the transmitted low frequency signals are conveyed via conductor 24*f* into filter 28, which routes the low frequency signals over conductor 24*a* to network 2. The high frequency signals are conveyed along conductors 24*c*, 24*d* between terminals 28*c,d* and terminals 30.

Figure 3:
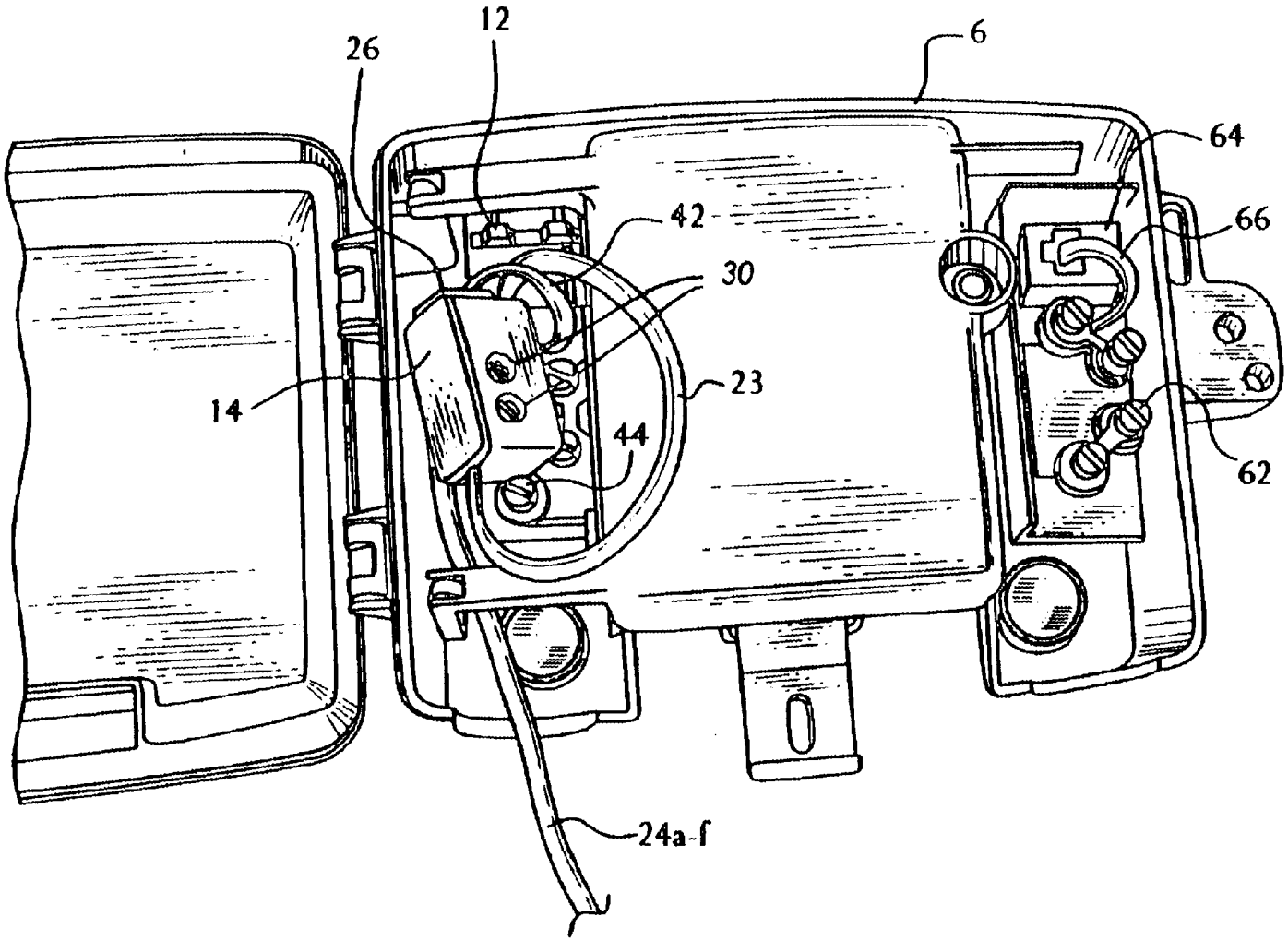
FIG. 3 depicts an interface adapter according to the present invention installed at a subscriber location.

FIG. 3 depicts a preferred embodiment of an interface adapter 14 according to the present invention installed at a subscriber location. As can best be seen on the right side of junction box 6, a set of four lugs 62 are connected to a receptacle connector 64 by a plug connector 66. As can best be seen on the left side of junction box 6, interface adapter 14 is interposed between lugs 44 and receptacle connector 12 (which is part of the NID). Before installation of interface adapter 14, plug connector 42 would have been connected to receptacle connector 12, thereby coupling lugs 44 with the NID (and, therefore, the network). During installation, however, plug connector 42 would have been removed from receptacle connector 12 and inserted into receptacle connector 26 of adapter 14. Plug connector 23 of adapter 14 would then have been inserted into receptacle connector 12. Consequently, lugs 44, as shown in FIG. 3, are coupled to the network through adapter 14. Thus, rather than requiring the installer to wrap wires around the lugs, or splice them to other wires already coupled to the lugs, interface adapter 14 permits installation of an ADSL filter by simple disconnection and connection of ordinary receptacle jacks connectors.

Thus there have been described apparatus and methods for providing a network interface adapter. Those skilled in the art will appreciate that numerous changes and modifications may be made to the preferred embodiments of the invention and that such changes and modifications may be made without departing from the spirit and scope of the invention. For example, although the invention has been described with reference to the installation of ADSL filters at a subscriber location, it should be understood that the invention is in no way limited thereto. It is therefore intended that the appended claims cover all such equivalent variations as fall within the true spirit and scope of the invention.

I claim:

1. An interface adapter for inserting an external digital subscriber line filter into a telephone network, the interface adapter comprising:

a housing that defines an interior region of the adaptor and an exterior region;

a plurality of electrical conductors extending into the interior region of the adaptor, the electrical conductors capable of connection to the filter wherein the filter produces distinct electrical signals from a combined signal of the network and wherein the filter is external to the interface adapter;

a plug connector coupled to a first subset of the electrical conductors, the first subset capable of connection to the network, the plug connector located in the exterior region;

a receptacle connector coupled to a second subset of the electrical conductors, the second subset suitable for carrying a first distinct electrical signal, the receptacle connector being accessible from the exterior region to receive a compatible plug connector;

an electrical port coupled to a third subset of electrical conductors, the third subset suitable for carrying a second distinct electrical signal;

wherein the first, second and third subset of electrical conductors extend outside the housing to the filter and are without a direct connection to one other.

2. The adapter of claim 1, wherein the housing includes a plug face, and the first subset of electrical conductors extends through the plug face between the interior region of the adapter and the plug connector.

3. The adapter of claim 1, wherein the housing includes a receptacle face, the receptacle connector is disposed on the receptacle face, and the second subset of electrical conductors extends through the interior region of the adapter to the receptacle connector.

4. The adapter of claim 3, wherein the housing includes a plug face, and the first subset of electrical conductors extends through the plug face between the interior region of the adapter and the plug connector.

5. The adapter of claim 4, wherein the housing includes a terminal face, and the electrical port is disposed on the terminal face such that the electrical port is accessible from the exterior region.

6. The adapter of claim 5, wherein an entrance face for the plurality of electrical conductors is opposite the terminal face, the plug face is opposite the receptacle face, and the entrance face extends between the plug face and the receptacle face.

7. The interface adapter of claim 1, wherein the plug connector and the receptacle connector are selected to be compatible with an in-line insertion of the interface adapter into the network.

8. The interface adapter of claim 1, wherein the plug connector interfaces to a telephone network, the filter is an asymmetrical digital subscriber line filter, the first distinct electrical signal is a voice signal and the second distinct electrical signal is a data signal.

* * * * *